United States Patent [19]

Moebius

[11] 4,257,135

[45] Mar. 24, 1981

[54] ASSEMBLY TOOL FOR TUBE FITTINGS

[75] Inventor: Kurt O. Moebius, Torrance, Calif.

[73] Assignee: Hackforth GmbH & Co. KG, Herne, Fed. Rep. of Germany

[21] Appl. No.: 59,752

[22] Filed: Jul. 23, 1979

Related U.S. Application Data

[63] Continuation-in-part of Ser. No. 856,499, Dec. 1, 1977, abandoned.

[51] Int. Cl.[3] ..... B25B 7/22

[52] U.S. Cl. ..... 7/125; 72/317; 81/423; 29/268

[58] Field of Search ..... 7/125, 158; 29/235, 29/268, 280, , 282; 72/317, 460; 81/423, 425 A

[56] References Cited

U.S. PATENT DOCUMENTS

| | | | |
|---|---|---|---|
| 1,085,461 | 1/1914 | Michaelis | 29/268 X |
| 1,350,904 | 8/1920 | Walters | 72/317 |
| 2,328,747 | 9/1943 | Schweidler | 7/158 |
| 3,143,790 | 8/1964 | Over et al. | 29/268 X |
| 3,585,704 | 6/1971 | Schroeder | 7/125 X |

FOREIGN PATENT DOCUMENTS

| | | | |
|---|---|---|---|
| 2032444 | 1/1972 | Fed. Rep. of Germany | 81/423 |

*Primary Examiner*—James G. Smith
*Attorney, Agent, or Firm*—Lyon & Lyon

[57] ABSTRACT

An assembly tool for tube fittings, including a pair of pivotal manually operated channel-shapped unique leg lever handles which nest one in the other and are provided with a pair of jaws which are connected to the lever handles by a set of low friction rotatable journal shafts, the extremities of the journal shafts being journalled in the lower handles; the journal shafts being positions to maintaine the jaws in parallel relation, while under load, and are provided with coaxial channels to receive the ends of a tube fitting and press the ends of the tube fitting toward each other thereby to cause interengagement of the fitting components; the jaws being readily interchangeable to assemble fittings of a different size or construction. A further embodiment includes a clamp means incorporated in one of the channels to grip a portion of the tube element, the other jaw receiving a flaring (swaging) tool for the clamped tube element.

6 Claims, 11 Drawing Figures

ASSEMBLY TOOL FOR TUBE FITTINGS

RELATED APPLICATION

This application is a continuation-in-part of U.S. Pat. application Ser. No. 856,499 filed Dec. 1, 1977 now abandoned.

BACKGROUND AND SUMMARY

Hand operated tools involving opposing jaws for holding, clamping, cutting and radial crimping are widely used. The jaws of the majority of such tools are pivotally mounted so that the jaws approach each other with an angular or non-parallel motion. In some tools the jaws are moved coaxially, however, such tools have, heretofore, been relatively expensive and often difficult to use and have limited travel.

The present invention is directed to a hand operated tool wherein the opposed jaws are moved coaxially to effect axial travel of internally control rings, causing radial compression, and is summarized in the following objects.

First, to provide an assembly tool having a pair of opposed U-shaped jaws which, while having substantial coaxial or parallel movement, maintain such movement under substantial force applied through angularly movable, manually operated arms so as to effect accurate axial travel of tube fitting components.

Second, to provide a tool, as indicated in the previous object, which is provided with readily interchangeable parts to accomodate fittings of different size and configuration.

Third, to provide an assembly tool as indicated in the preceding objects, wherein rotatable journal pins connect the handle arms and jaw components in such a manner as to minimize friction whereby maximum force will be available at the jaws without friction loss.

Fourth, to provide a tool, as indicated in the other objects, wherein novelly arranged channel-shaped handles are nested together and support opposed jaws by means of only a pair of pins which are arranged for ready removal in order to separate the jaws from the operating arms.

Fifth, to provide a tool, as indicated in the other objects, wherein selected pins have heads which are retained between a pair of flanges in such a manner that the heads serve as slide bearings to reduce friction.

Sixth, to provide an assembly tool which is particularly adopted for assemblying fittings such as disclosed in U.S. Pat. Nos. 3,827,727 and 3,893,720.

Other and additional objects of this invention will become evident upon a reading of the entire specification, drawings and claim.

DETAILED DESCRIPTION

Figure 1:
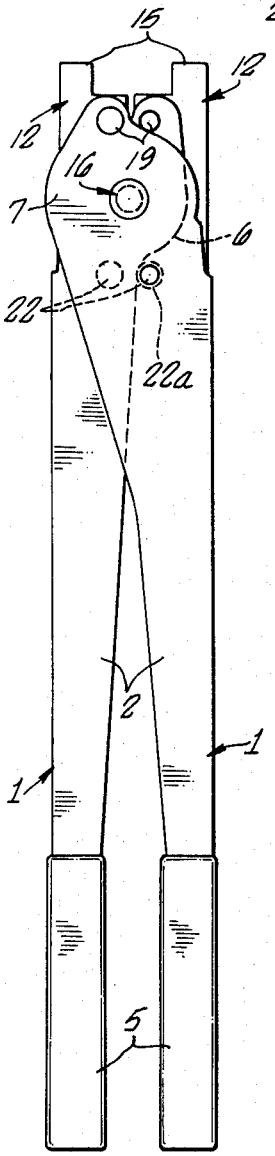
FIG. 1 is a side view of the assembly tool for tube fittings shown in its closed position.

The assembly tool includes a pair of handle structures 1 which are preferably identical. Each handle structure is channel-shaped in cross-section and includes elongated lever arms 2 comprising parallel flanges 3 joined by a web 4. The extended ends of the arms are provided with hand grips 5.

The flange portions of the handle structures 1 opposite from the hand grips 5 increase in width to form flat journal plates 6 and 7. The journal plate 6 is smaller in area than the journal plate 7. Both plates of each handle structure are provided with a pair of centrally disposed main journal perforations 8. The journal plates 6 and 7 are essentially circular and are provided with extensions 9 directed upwardly as viewed in the drawings. Each pair of extensions 9 is provided with a pair of coaxial journal perforations 10. Diametrically from the extensions 9 opposite and equally spaced from the journal perforations 8, each pair of plates 6 and 7 is provided with a second pair of journal perforations 11.

Each handle structure receives between the plates 6 and 7 a jaw member 12 in the form of a rectangular bar having a lateral extending boss 13. Each extension is provided with a transverse journal bore 14. The bore 14 and lateral bar extension 13 is closer to the upper end of the jaw member as viewed in the drawings. This end of each jaw member is provided with a fitting-receiving channel 15. The other or larger portion **12*a* of the jaw member extends downwardly passed the journal perforation 11**.

The two handle structures 1 are joined by a main journal shaft 16, one end of which may be provided with a head 17 and the other with a split retainer ring 18. The journal perforations 10 and bore 14 of each jaw member receives a jaw journal shaft 19 having a central groove 20. Extending radially from the groove 20 is a detent screw 21 or a ball and spring detent may be utilized.

Figure 6:
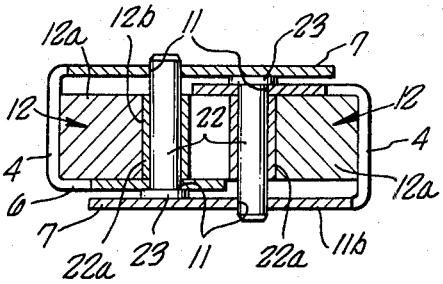
Figure 7:
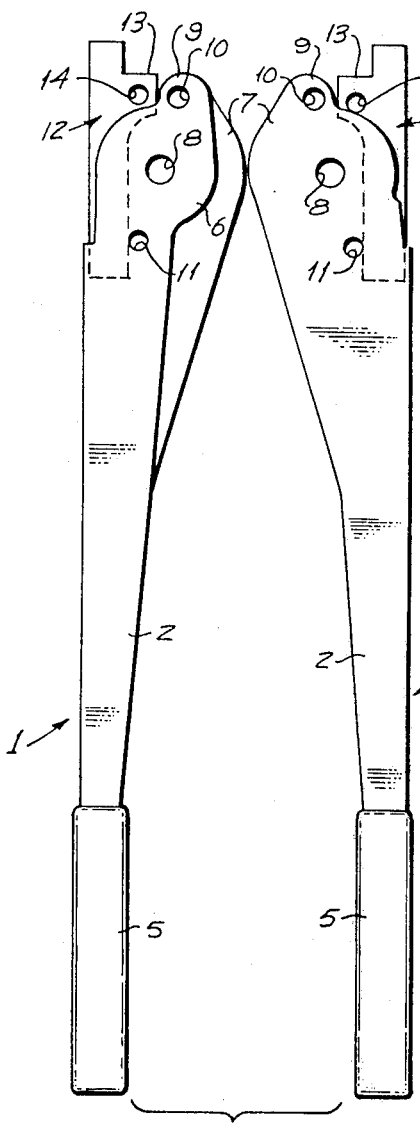
FIG. 7 is a side view similar to FIG. 1 but showing the two handle sub-assemblies separated.

The journal performation 11 receive bearing pins 22, which are slidably engaged by the extended parallel confronting slide bearing surfaces **12*b* of the portions of the jaw members 12. Each bearing pin 22 is provided with a head 23. The shaft of the bearing pin 22 extends through both flanges or journal plates of the corresponding handle structure. Each journal plate includes an arcuate extension which fits over the head of the bearing pin mounted in the other handle structure, thus no fastening means other than the journal plates of the handle structures are required to hold the bearing pins in place. In order to accomplish this, both handle structures 1 are identical and the plate 6 of each handle structure is placed against the corresponding jaw member whereas the journal plate 7 overlies the journal plate 6 and is spaced therefrom by the bearing pin head 23, as shown in FIG. 6. In addition to the heads 23, the main journal shaft 16 may be provided with washers 25**.

Bearing pins 22 may be provided with cylindrical rollers 22*a* about their periphery. Such rollers 22 produce a rolling friction when the handle structures are activated. Such rollers 23, may be replaced when worn, and replacement rollers 22*a* may be of increased thickness in order to account for wear of pin 22 and/or wear of the whole tool to retain parallism.

Figure 2:
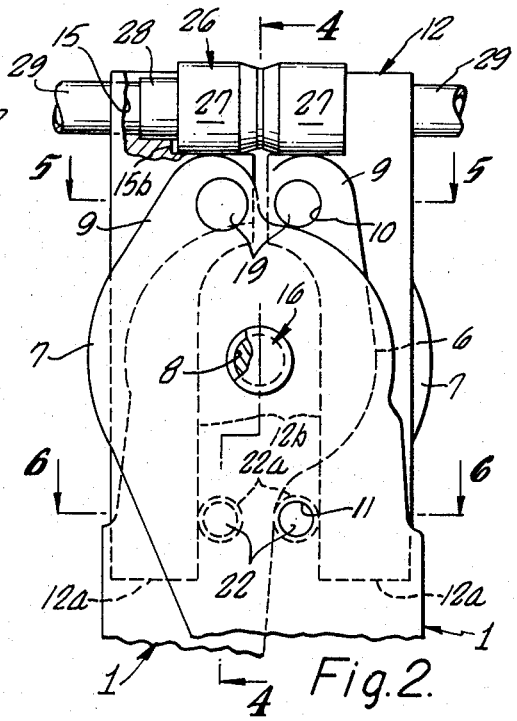
FIG. 2 is an enlarged fragmentary side view thereof showing a tube fitting as it appears when joined.
Figure 4:
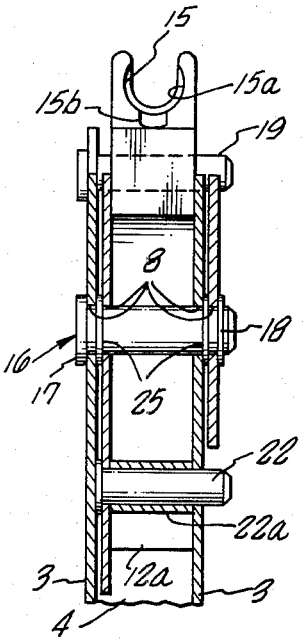
FIG. 4 is a fragmentary sectional view through 4—4 of FIG. 2.
Figure 3:
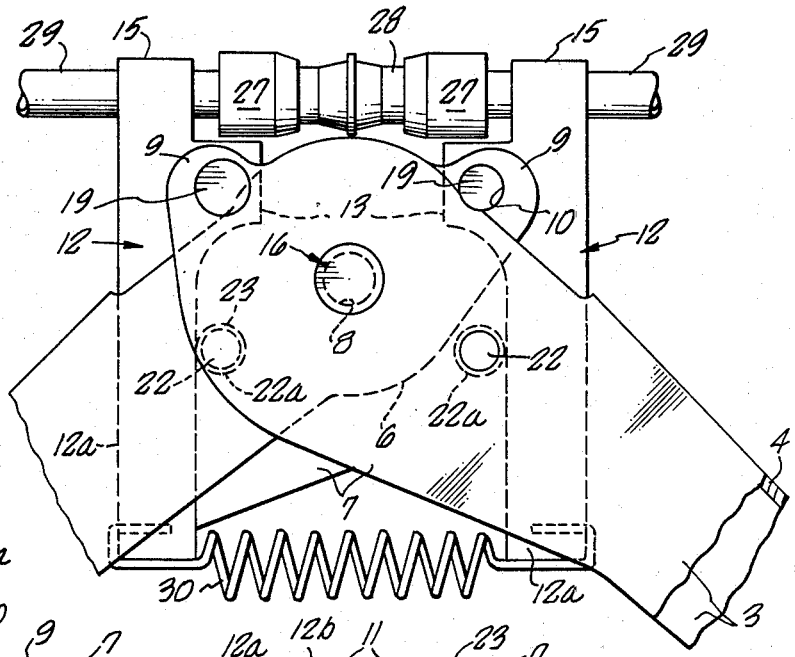
FIG. 3 is an enlarged fragmentary view similar to FIG. 2, but showing the assembly tool expanded to receive a tube fitting.

As previously indicated, the assembly tool is particularly adapted for the assembly of tube fittings more fully disclosed in the patents previously identified herein. More particularly, the fitting, designated 26, includes a pair of lock rings 27 slidably mounted on a sleeve 28 initially slidably received over abutting tubing ends 29. As shown in FIG. 3, the tubing ends are received in channels 15 when the jaw members 12 are separated their major distance by the handle structures are moved from the position shown in FIG. 3 to the position shown in FIG. 2, the jaw members which remain in parallel relation press the lock rings 27 over the ends of the sleeve 28. In order that the channels 15 receive the ends of the sleeve 28, the conforming ends of the channels 15*a* have a peripheral extent greater than 180° so that once the ends of the sleeves are received therein, the fitting is retained in place on the assembly tool. The axial extent of the enlarged portions 15*a* is predetermined so that the lock rings 27 are moved to a fixed distance from the exposed extremities of the sleeve 28.

Channel 15 is further provided with a recess 15*b* at the channel bottom which improves fitting alignment as the fitting is engaged by the channel sides.

The confronting slide bearing surfaces 12*b* of the longitudinally extending portion 12*a* of each jaw member 12 extends past the laterally outer sides of the journal pins 22. The resistance force produced by the fitting 26 as the parts of the fitting are pressed toward each other maintains the parallel confronting slide bearing surfaces 12*b* in contact with the journal pins 22, so that the jaw members remain in parallel relation through the range of movement provided by the handle structures 1. If desired, however, a tension spring 30 may extend between the extremities of the longitudinally extending portions 12*a* as shown in FIG. 3.

Figure 5:
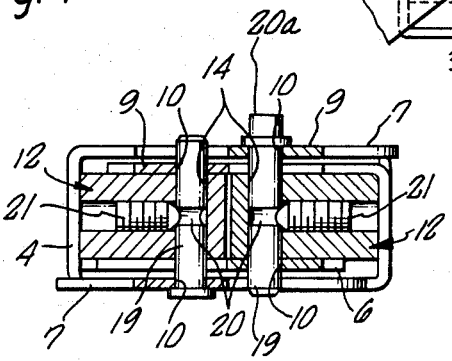
FIGS. 5 and 6 are transverse sectional views taken through 5—5 and 6—6 of FIG. 2.

It is intended to provide sets of jaw members having fitting receiving channels 15 and 15*a* of different sizes. Interchanging the jaw members is readily accomplished merely by removal of the journal shafts 19. This is accomplished by releasing the screw threaded detent shown in FIG. 5, then pressing the shaft 19 free. If a ball and spring detent is used, it is merely necessary to overcome the resistance of the ball detent. The spring and ball detent is not illustrated as it is, per se, conventional. If the spring 30 is provided, it is of course necessary to remove the spring 30 when interchanging the jaw members.

Figure 8:
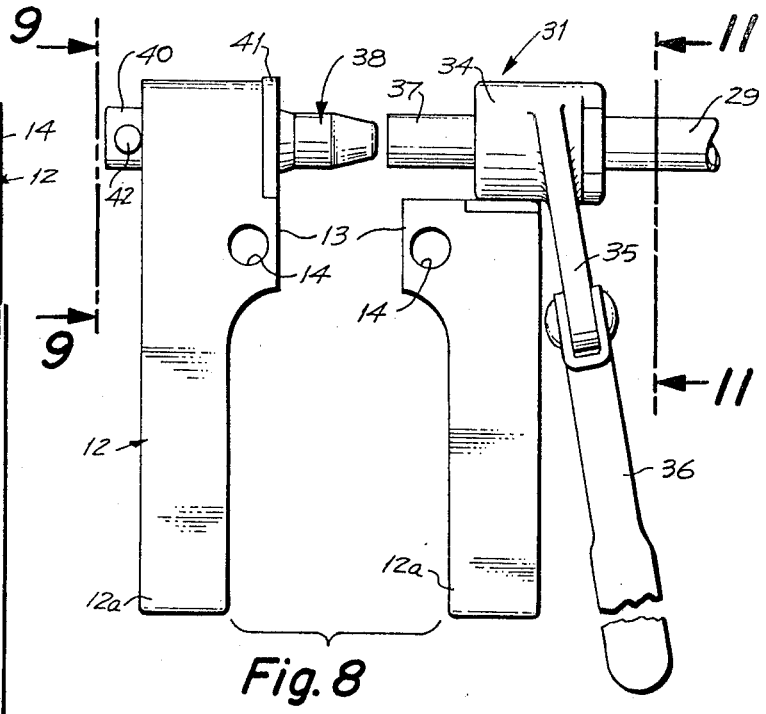
FIG. 8 is an enlarged view showing a pair of jaw members, one equipped with a vice grip and the other arranged to receive a tube expander.
Figure 9:
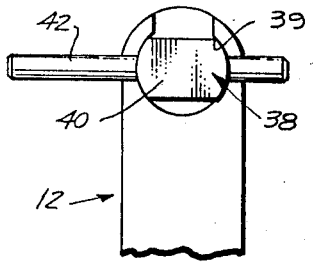
FIG. 9 is a fragmentary sectional view taken through 9—9 of FIG. 8.
Figure 11:
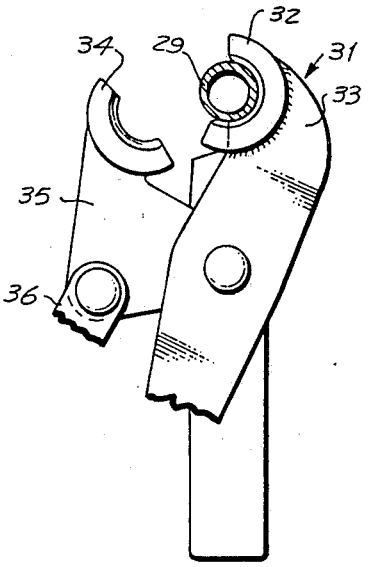
FIG. 11 is a fragmentary side view taken through 11—11 of FIG. 8.
Figure 10:
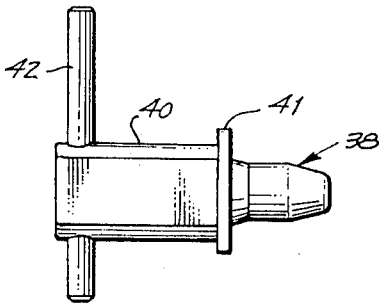
FIG. 10 is a side view of a tube flaring pin.

The jaw members may be modified in other respects than the size of the channel 15. Referring to FIGS. 8 and 10, one of the jaw members may be provided with a conventional vice grip 31 in which one clamp jaw 32 is fixed to the jaw member 12 in place of the channel 15 and is provided with a fixed handle 33. A second or movable clamp jaw 34 is pivotally connected to the fixed handle by an arm 35. The movable clamp jaw 34 is connected to a movable handle 36. Except for the configuration of the fixed clamp jaw 32 and movable clamp jaw 34, the vice grip structure 31 is conventional. Each of the clamp jaws 32 and 34 is semi-cylindrical. One jaw may be in excess of 180°.

The vice grip 31 is primarily intended for gripping a tube member 37 near its end to permit the tubing end to be expanded [and to be followed by joining two tubes by means of a SINGLE RING LORRING JOINT]. This is accomplished by a flaring pin 38 carrier by a modification of the other of the jaw members 12. Instead of the channel 15, a longitudinally slotted sleeve 39 is provided which receives a bar 40 coaxial with the flaring pin 38. Opposite sides of the bar are flattened so that it may be inserted in the sleeve 39. A flange 40 limits axial displacement of the flaring pin 38. The bar 40 protrudes from the jaw member 12 and receives a handle bar 42.

To flare an end of a tube member 37, the lubricated flaring pin and its modified jaw member are secured in place, and the other modified jaw member and its vice grip are also secured in place. A tube member is clamped by the vice grip. The handle structures are then operated to force the flaring pin into the end of the tube member. The resulting flared tube may be used to assemble a modification of the fitting shown in the previously mentioned patent application.

Spring ball retained fast change pins to the specification drawing with long [protruding] head 20*a* prevents accidental displacement of ball-spring detented pins. The channels of the handles 1 are flat, and thereby able to carry much greater loads without distortion for precise parallel action.

Having fully described my invention, it is to be understood that I am not to be limited to the details herein set forth, but that my invention is of the full scope of the appended claims.

I claim:

1. An assembly tool for tube joints, having opposed coaxial components capable of being secured by axial contraction, the assembly tool comprising:

a. a pair of bar members disposed in confronting coplanar relation, each having a bearing bore near one end, its opposite end being extended, the bearing bores being disposed in parallel relation;

b. a pair of handle members, each handle member including a pair of flat plates overlying opposite sides of the bar members, the plates of each handle member having first openings in registry with opposite ends of corresponding bearing bores, second openings defining a common axis spaced equally from the first openings, and third openings diametrically disposed with respect to the first openings;

c. journal pins for the first openings received in the bearing bore of each bar member, a main journal pin received in the second openings and extending between the bar members, and stop pins received in the third openings, for engagement by the bar member extensions, the spacing of the pins being such that relative angular movement of the handle members causes coaxial movement of the bar members, each of said stop pins extending through said flat handle plates and being provided with a stop pin head;

d. tool means carried by each bar member defining a common axis and contoured to receive the components of the tube joint to effect axial contraction, each bar member being removable by removal of its journal pins whereby a tool means of different configuration may be substituted; and wherein e. one plate of each handle member includes a portion of increased radius which overlies the head of the stop pin received in the other handle member to retain the stop pin in place, the contacting portions of the head and portion of increased radius forming a slide bearing to reduce friction.

2. An assembly tool, as defined in claim 1 wherein:

a. one of the tool means includes a gripping device having relatively movable, interlocking jaws for clamping a tube.

3. An assembly tool, as defined in claim 1 wherein:

a. the other of the tool means includes a tube expander for the tube when clamped by the jaws.

4. An assembly tool, as defined in claim 1, wherein:

a. pairs of bar members are provided having different holding means;

b. and said journal pins are readily removable, and when removed, permitting separation of the bar members from the handle members whereby different pairs of bar members may be interchangeably secured to the handle members.

5. An assembly tool, as defined in claim 1, wherein:

a. each bar member is removable upon removal of its journal pin, for substitution of a bar member having a different holding means.

6. An assembly tool for the tube joints, having opposed coaxial components capable of being secured by axial contraction, the assembly tool comprising:

a. a pair of bar members disposed in confronting coplanar relation, each having a bearing bore near one end, its opposite end being extended, the bearing bores being disposed in parallel relation;

b. a pair of handle members, each handle member including a pair of flat plates overlying opposite sides of the bar members, the plates of each handle member having first openings in registry with opposite ends of corresponding bearing bores, second openings defining a common axis spaced equally from the first openings, and third openings diametrically disposed with respect to the first openings;

c. journal pins for the first openings received in the bearing bore of each bar member, a main journal pin received in the second openings and extending between the bar members, and stop pins received in the third openings, for engagement by the bar member extensions, the spacing of the pins being such that relative angular movement of the handle members causes coaxial movement of the bar members, each of said stop pins extending through said flat handle plates and being provided with a stop pin head;

d. tool means carried by each bar member defining a common axis and contoured in a channel configuration, the channel bottom having a recess therein, to receive the components of the tube joint to effect axial contraction, each bar member being removable by removal of its journal pins whereby a tool means of different configuration may be substituted; and wherein e. one plate of each handle member includes a portion of increased radius which overlies the head of the stop pin received in the other handle member to retain the stop pin in place, the contacting portions of the head and portion of increased radius forming a slide bearing to reduce friction.

* * * * *